US005611665A

United States Patent [19]

Angel

[11] Patent Number: 5,611,665

[45] Date of Patent: Mar. 18, 1997

[54] MARINE PROPELLER AND METHOD

[76] Inventor: Bruce A. Angel, 9035 Mount Carmel Rd., Stokesdale, N.C. 27357

[21] Appl. No.: 531,387

[22] Filed: Sep. 21, 1995

[51] Int. Cl.[6] ..... B63H 3/12

[52] U.S. Cl. ..... 416/1; 416/205; 416/209

[58] Field of Search ..... 416/205, 206, 416/207, 209, 1; 440/50

[56] References Cited

U.S. PATENT DOCUMENTS

| | | | |
|---|---|---|---|
| 3,323,710 | 6/1967 | Daly | 416/207 |
| 3,790,304 | 2/1974 | Langlois . | |
| 3,794,441 | 2/1974 | Johnson . | |
| 4,020,781 | 5/1977 | Bellew . | |
| 4,960,397 | 10/1990 | Suttmeier . | |
| 5,246,343 | 9/1993 | Windsor et al. | 416/210 R |

FOREIGN PATENT DOCUMENTS

| | | | |
|---|---|---|---|
| 1400856 | 11/1968 | Germany | 416/207 |
| 2550755 | 5/1977 | Germany | 416/207 |

*Primary Examiner*—Edward K. Look
*Assistant Examiner*—Christopher Verdier

[57] ABSTRACT

A marine propeller includes a series of releasably affixed blades which allow pitch adjustment. The blades are each secured to different blade disks which are positioned in hub wells and held by positioning pins. The method describes how the blades, which are each attached to blade disks at preselected positions can be released, rotated and reaffixed. The disk can then be rotated in the opposite direction on the hub in a smaller increment, to provide more or less pitch as needed.

18 Claims, 2 Drawing Sheets

MARINE PROPELLER AND METHOD

BACKGROUND OF THE INVENTION

1. Field of the Invention

A marine propeller and method is provided for yachts, boats and ships which includes releasably mounted propeller blades which can be removed as desired and rotated to obtain a selected pitch. Threaded members hold the blades onto a blade disk which is affixed to the propeller hub. The blades can be removed, rotated and reaffixed by using the method to provide a different pitch as needed.

2. Description of the Prior Art and Objectives of the Invention

Many types of propellers attached to boat motor shafts have been used over the years for boats and ships of different sizes. Smaller boats have usually been fitted with a propeller having blades of fixed pitch, whereas certain larger ships have utilized propellers in which the blade pitch can be changed during operation, such as set forth in U.S. Pat. Nos. 3,794,441; 4,020,781; and 4,960,397. U.S. Pat. No. 3,790, 304 utilizes blades which are held in place by threaded members which can be loosened and the pitch changed. Certain of the devices shown in these references have blades which are difficult to precisely adjust, whereas others have propellers which are labor intensive to modify. Other prior art references do not provide the ease and precision of adjustment needed for quick propeller modification and efficient engine performance.

Thus, with the need for a marine propeller with exact pitch adjustment, it is an objective of the present invention to provide a propeller in which each of the propeller blades can be precisely and releasably moved along a central hub.

It is still another objective of the present invention to provide a marine propeller in which each of the blades are releasably fastened to a blade disk attached to the hub.

Another objective of the present invention is to provide a marine propeller in which the blades can be rotated about a blade disk and secured thereto with bolts and positioning pins.

Still another objective of the present invention is to provide a marine propeller which includes a series of disk wells for receiving the blade disks.

A further objective of the invention is to provide a blade disk which has a frustum configuration.

An additional objective of the invention provides a method of precise blade adjustment in one inch increments of pitch.

The aforesaid and other objectives and advantages of the present invention will become apparent to those skilled in the art as a more detailed explanation is presented below.

SUMMARY OF THE INVENTION

A marine propeller is designed to allow the user to adjust the pitch of each of the propeller blades in accordance with the desired intent and needs of the boat manufacturer, owner or captain. For example, the blade pitch can be set to a preselected position and later, if needed, the propeller blades can be changed to a different pitch in one inch increments without the necessity of buying a new propeller or propeller blades. The invention includes a metal hub having a series of peripheral disk wells, each of which receive a frustum shaped blade disk. Each blade disk has a series of threaded openings for receiving threaded members or bolts which hold the blades in fixed posture. The blade disks are secured within the disk wells by large threaded bolts which are recessed in threaded openings in the bottom of the disk wells. If it is desirable to change the blade pitch, the threaded members which hold the blade to the disk are loosened and removed. Next, the blade disk and blade can be lifted from the well and rotated in a counter-clockwise (or clockwise) direction and the large threaded bolt replaced. The blades can then be turned in a clockwise or counter clockwise manner a desired amount, dependent on the need of a positive or negative pitch requirement. As would be understood, each blade is so positioned in an identical manner and the propeller is then again ready for operation.

DETAILED DESCRIPTION OF THE PREFERRED EMBODIMENT AND OPERATION OF THE INVENTION

Figure 1:
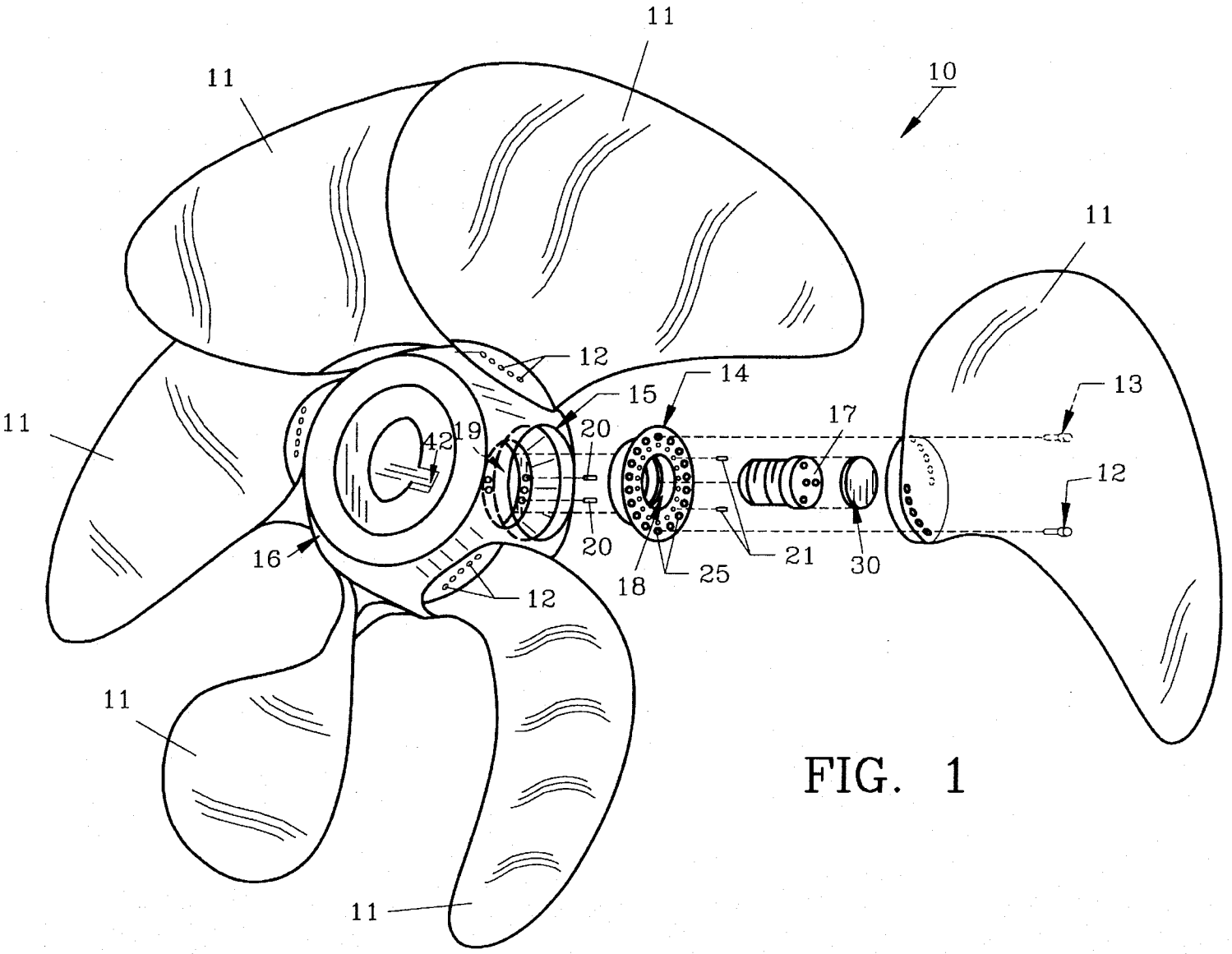
FIG. 1 illustrates a perspective view of the preferred form of the right-handed marine propeller invention, as would be mounted on the boat from a forward position looking aft, with one blade exploded therefrom.

For a better understanding of the invention, a right-handed marine propeller 10, the preferred configuration, is shown in FIG. 1 in somewhat exploded fashion from a forward view looking aft. Propeller 10 includes six propeller blades 11 with five such blades affixed to hub 16 which includes keyway 42. Blades 11 and hub 16 are cast of conventional metal alloys as are used to form propeller hubs and blades in the marine industry. Blades 11 are all adjustable relative to hub 16 in that bolts 12 and 13, which act as a member to secure blades 11, can be removed and blades 11 and blade disks 14 rotated. As further shown in FIG. 1, each blade 11 is affixed to a disk 14 by five threaded bolts 12 along the front of each blade and five bolts 13 along the rear of each blade 11. The pitch or position of each blade 11 is identically set around hub 16 for more or less pitch as desired, and each blade 11 can be rotated relative to disk 14 in 20° increments, as shown by 20° angle A FIG. 3, along the top of disk 14. Angle B, shown along the bottom of disk 14 in FIG. 5, equals 19.7°. In use, a boat, which for example may be a 60 foot yacht having properly sized twin propellers, can be set with the blades 11 at any suitable initial pitch. The yacht can then be placed in the water and steered about for testing.

Figure 3:
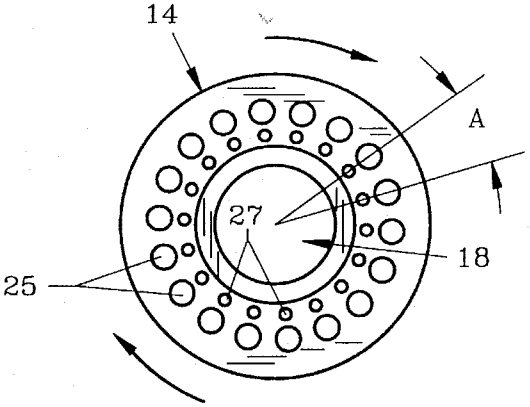
FIG. 3 shows a top plan view of the blade disk as seen in FIG. 1.

If reduced engine load is needed at a particular throttle setting, the preferred method allows blades 11 to be removed from hub 16 and rotated in 20° increments, for example in a clockwise direction as shown by the arrows in FIG. 3, about blade disk 14. As 20° of rotation equals a decrease of 66.6 inches of pitch, which is generally an extremely radical adjustment, disk 14 is removed from disk well 15 and can be turned in 19.7° increments (as seen at angle B) in a counter-clockwise direction, providing a resultant 0.3° net change. This 0.3° net rotation of blade 11 equals a reduced one (1) inch pitch change. If a one inch pitch change is not adequate the method can be repeated as many times as necessary to obtain the desired pitch under the particular circumstances.

If, on the other hand, a greater engine load is needed, the pitch of each of the blades 11 can be increased by removing bolts 12 and 13 on each of blades 11 and blades 11 rotated in accordance with the preferred method in a counter-clockwise direction relative to blade disk 14 of FIG. 3 in 20° increments, and blade disk 14 rotated in a clockwise direction in 19.7° increments for the resultant net pitch as needed.

Figure 2:
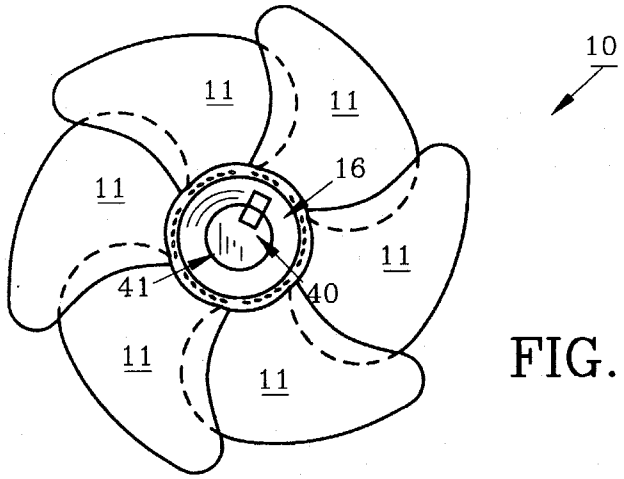
FIG. 2 demonstrates a plan view of the propeller disk as shown in FIG. 1 from an aft position looking forward.

FIG. 2 demonstrates an assembled rear looking forward view of marine propeller 10 as seen in FIG. 1, whereby hub 16 includes shaft stub 40 within hub shaft channel 41 for coupling with a conventional propeller shaft (not shown).

Figure 4:
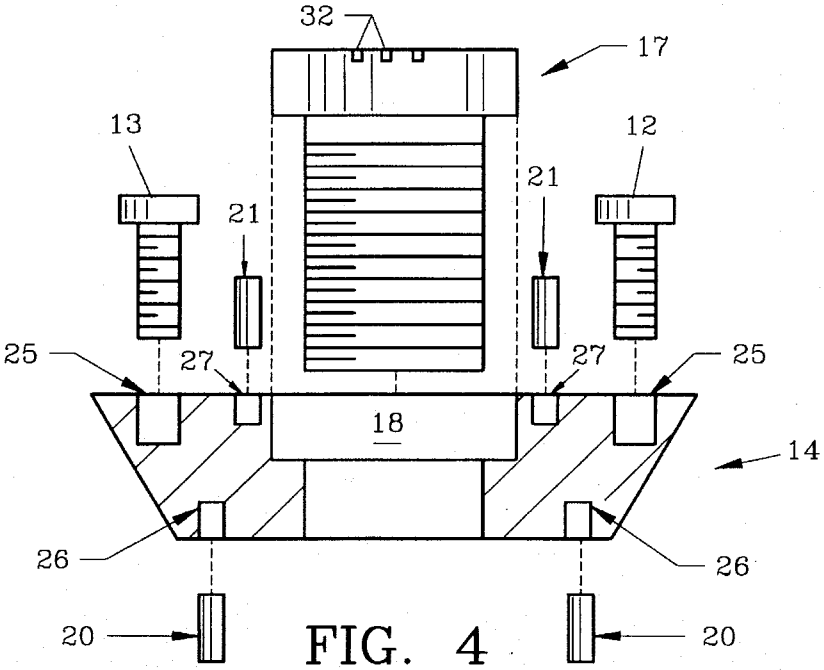
FIG. 4 depicts a schematic cross-sectional side elevational view of the blade disk as seen in FIG. 3.

While only one blade 11 and certain associated components are shown exploded in FIG. 1, the remaining five blades 11 are all identically attached to hub 16 which defines a total of six disk wells 15 to receive blade disks 14 therein. In order to secure disk 14 in disk well 15, a large threaded bolt 17 is used, which can be tightened by a spanner wrench. Bolt 17 slides through top opening 18 in disk 14 and attaches to a threaded opening (not seen) in bottom 19 of disk well 15. Five positioning pins 20 (only 2 shown for clarity) as seen in FIGS. 1 and 4, are utilized to prevent rotation between disk 14 and hub 16. Two positioning pins 21, as also shown in FIGS. 1 and 4, provide structural integrity and positioning for the attachment of blades 11 and hub 16.

A resilient washer 30 is depicted in FIG. 1 manufactured of a deformable material such as a rubber or a synthetic polymer material. Washer 30 is placed on the head of bolt 17 and is deformable into spanner wrench openings 32, as seen in FIG. 4 as blade 11 is tightened by bolts 12, 13 onto blade disk 14. Washer 30 may be approximately 0.060" thick and prevents bolt 17 from loosening by vibration of propeller 10 as may occur during use.

Figure 5:
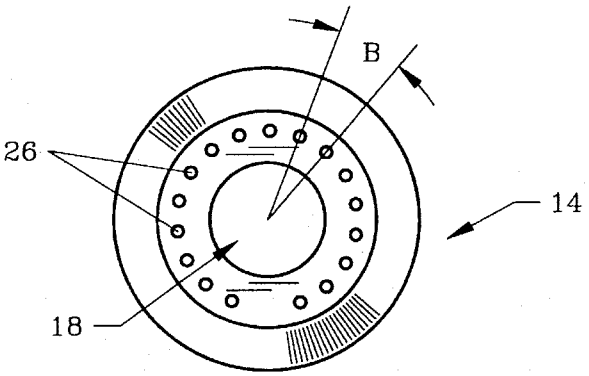
FIG. 5 shows a bottom plan view of the blade disk as seen in FIG. 3.

The preferred disk 14 as shown in FIGS. 3 and 5 defines a series of 18 threaded apertures 25 spaced at 20° increments for receiving bolts 12 and 13. Eighteen top pin holes 27 also have 20° increments for receiving positioning pins 21. Seventeen bottom pin holes 26 on frustum-shaped blade disk 14 are spaced at 19.7° increments for receiving positioning pins 20, as seen in FIG. 4, to secure blade 11 thereto. The preferred form of blade disk 14 also comprises the frustum shape as shown in FIG. 4 as this shape allows easy insertion into wells 15 and provides the needed surface area for receiving threaded bolts 12 and 13 and positioning pins 20, 21 required.

The right-handed propeller examples and illustrations shown herein are for explanatory purposes and are not intended to limit the scope of the appended claims as the invention concept would be also applicable to left-handed propellers.

I claim:

1. A marine propeller comprising: a hub, a first propeller blade, said blade having pitch, a blade disk, said blade disk affixed to said hub, said first propeller blade releasably attached to said blade disk, said blade disk defining a plurality of apertures, said apertures arranged in a circular pattern, said blade disk defining a plurality of bottom pin holes, said bottom pin holes arranged in a circular pattern, said blade adjustably, releasably affixed to said hub whereby the pitch of said blade is adjustable by rotating said blade on said blade disk relative to said hub.

2. The marine propeller of claim 1, wherein said hub defines a disk well, said blade disk positioned in said disk well.

3. The marine propeller of claim 1 and including means to rigidly secure said blade disk to said hub, said blade disk securing means attached to said hub.

4. The marine propeller of claim 1 and including means to secure said first propeller blade to said disk, said propeller blade securing means for releasable attachment to said first propeller blade.

5. The marine propeller of claim 1 wherein said disk is frustum shaped.

6. The marine propeller of claim 1 and including a positioning pin, said positioning pin attached to said disk.

7. The marine propeller of claim 1, and including a second propeller blade, said second propeller blade adjustably affixed to said hub.

8. A marine propeller comprising: a hub, a plurality of propeller blades, a plurality of blade disks, each of said blade disks affixed to said hub for releasably securing one of said propeller blades, said blade disks each defining a series of apertures, said apertures arranged in a circular pattern, said apertures spaced apart by a first angular amount, said blade disks each defining a series of top pin holes, said top pin holes arranged in a circular pattern, said top pin holes spaced apart by a first angular amount, said blade disks each defining a series of bottom pin holes, said bottom pin holes arranged in a circular pattern, said bottom pin holes spaced apart by a second angular amount, said first angular amount different from said second angular amount, means to secure one each of said propeller blades to one each of said blade disks, said propeller blade securing means for selective reception in one of said apertures, and a plurality of pins, said pins for positioning in said top pin holes.

9. The marine propeller of claim 8 wherein each of said blade disks is frustum shaped.

10. The marine propeller of claim 8, wherein said hub defines a plurality of disk wells, one of said blade disks positioned in one of said disk wells.

11. The marine propeller in claim 8, and including a plurality of means to secure said blade disks to said hub, one of said plurality of blade disk securing means attached to one of said blade disks.

12. The marine propeller in claim 8, wherein said hub defines a shaft channel.

13. The marine propeller in claim 8, wherein said plurality of propeller blades comprises six blades.

14. The marine propeller of claim 8, wherein said first angular amount is greater than said second angular amount.

15. The marine propeller of claim 8, wherein said blade disk comprises a top and a bottom, said top pin holes defined by said blade disk top, and said bottom pin holes defined by said blade disk bottom.

16. A method of adjusting a propeller having a removable blade, said blade having an adjustable pitch, said propeller having a blade disk attached to a central hub, said blade disk having a plurality of apertures, said apertures arranged in a circular pattern, said apertures spaced apart by a first angular amount, said blade disk having a plurality of bottom pin holes, said bottom pin holes arranged in a circular pattern, said bottom pin holes spaced apart by a second angular amount, said first angular amount different from said second angular amount, the method comprising the steps of:

(a) rotating the blade disk in a first direction by said first angular amount relative to the hub, (b) affixing the rotated blade disk to the hub, (c) rotating the blade relative to the blade disk in an opposite direction by said second angular amount for a net pitch change of the propeller blade equal to the difference between said first angular amount and said second angular amount.

17. The method of claim 16 wherein the step of rotating the blade disk in a first direction comprises rotating the blade disk in a clockwise direction.

18. The method of claim 16 wherein the step of affixing the rotating blade disk comprises the step of affixing the rotated blade disk with a threaded member.

* * * * *